US011441504B2

(12) United States Patent
Sugimoto

(10) Patent No.: US 11,441,504 B2
(45) Date of Patent: Sep. 13, 2022

(54) CONTROLLER AND CONTROL METHOD FOR INTERNAL COMBUSTION ENGINE

(71) Applicant: TOYOTA JIDOSHA KABUSHIKI KAISHA, Toyota (JP)

(72) Inventor: Hitoki Sugimoto, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 17/559,690

(22) Filed: Dec. 22, 2021

(65) Prior Publication Data

US 2022/0220914 A1 Jul. 14, 2022

(30) Foreign Application Priority Data

Jan. 8, 2021 (JP) ..... JP2021-002104

(51) Int. Cl.

| | |
|---|---|
| ***F02D 41/14*** | (2006.01) |
| ***F02D 41/22*** | (2006.01) |
| ***F02D 41/00*** | (2006.01) |
| ***F01N 11/00*** | (2006.01) |
| ***F02D 41/02*** | (2006.01) |

(52) U.S. Cl.

CPC ..... *F02D 41/1475* (2013.01); *F01N 11/007* (2013.01); *F02D 41/0087* (2013.01); *F02D 41/0295* (2013.01); *F02D 41/1454* (2013.01); *F02D 41/222* (2013.01); *F01N 2550/02* (2013.01); *F01N 2900/1624* (2013.01); *F02D 2200/0816* (2013.01)

(58) Field of Classification Search

CPC ..... F02D 41/0087; F02D 41/0295; F02D 41/1408; F02D 41/1454; F02D 41/1475; F02D 2200/0814; F02D 2200/0816; F01N 11/007; F01N 2900/1624

USPC ..... 701/103, 109; 123/198 F, 481

See application file for complete search history.

(56) References Cited

U.S. PATENT DOCUMENTS

| | | | | |
|---|---|---|---|---|
| 10,830,169 | B1 * | 11/2020 | Banker | F02D 13/06 |
| 2004/0226282 | A1 | 11/2004 | Hattori | |
| 2011/0265771 | A1 * | 11/2011 | Banker | F02D 35/027 123/564 |
| 2014/0318496 | A1 * | 10/2014 | Yoshida | F02D 41/126 123/332 |

(Continued)

FOREIGN PATENT DOCUMENTS

| | | | |
|---|---|---|---|
| JP | 2004-019542 | A | 1/2004 |
| JP | 2010-174805 | A | 8/2010 |

*Primary Examiner* — Erick R Solis

(74) *Attorney, Agent, or Firm* — Finnegan, Henderson, Farabow, Garrett & Dunner, LLP

(57) ABSTRACT

A controller for an internal combustion engine includes processing circuitry that executes a richening process until an exhaust sensor detects exhaust gas having a rich air-fuel ratio. The processing circuitry executes an air supplying process to supply a catalytic converter with air until the exhaust sensor detects that the exhaust gas has a lean air-fuel ratio. The processing circuitry cumulates the amount of air supplied to the catalytic converter until the exhaust sensor detects that the exhaust gas has a lean air-fuel ratio in the air supplying process. The air supplying process includes stopping fuel supplied to the one or more of the cylinders and performing combustion at an air-fuel ratio that is less than or equal to the stoichiometric air-fuel ratio in the remaining one or more of the cylinders.

7 Claims, 4 Drawing Sheets

(56) References Cited

U.S. PATENT DOCUMENTS

| | | | | |
|---|---|---|---|---|
| 2017/0175656 | A1* | 6/2017 | Masubuchi | F02D 41/1475 |
| 2019/0360413 | A1* | 11/2019 | Uhrich | F02D 41/0005 |
| 2022/0120231 | A1* | 4/2022 | Sugimoto | F02D 41/1498 |

* cited by examiner

CONTROLLER AND CONTROL METHOD FOR INTERNAL COMBUSTION ENGINE

BACKGROUND

Field

The following description relates to a controller for an internal combustion engine and a method for controlling an internal combustion engine.

Description of Related Art

Japanese Laid-Open Patent Publication No. 2010-174805 describes a controller for an internal combustion engine including an exhaust passage provided with a catalytic converter that purifies exhaust gas, an upstream air-fuel ratio sensor located at an upstream side of the catalytic converter, and a downstream air-fuel ratio sensor located at a downstream side of the catalytic converter.

A process for calculating the stored oxygen capacity of the catalytic converter is known in the art. Specifically, a controller first sets a target air-fuel ratio to an air-fuel ratio that is richer than the stoichiometric air-fuel ratio. This will result in the air-fuel ratio of the exhaust gas at the downstream side of the catalytic converter becoming rich after a certain time delay. This indicates that the oxygen stored in the catalytic converter has all been released from the catalytic converter. Then, the controller sets a target air-fuel ratio to an air-fuel ratio that is leaner than the stoichiometric air-fuel ratio. This will result in the air-fuel ratio of the exhaust gas at the upstream side of the catalytic converter becoming lean after a certain time delay. This indicates that lean combustion has started supplying oxygen to the catalytic converter. After the supply of oxygen to the catalytic converter starts, the amount of oxygen stored in the catalytic converter increases. When oxygen is being stored in the catalytic converter and the stored oxygen amount is increasing, the amount of oxygen released from the catalytic converter toward the downstream side is subtle. When the stored oxygen amount is increasing in the catalytic converter, the downstream air-fuel ratio sensor continues to detect a rich air-fuel ratio. When the stored oxygen amount of the catalytic converter reaches a stored oxygen capacity, further oxygen cannot be stored. This will result in the oxygen flowing toward the downstream side of the catalytic converter. Thus, when the stored oxygen amount of the catalytic converter reaches the stored oxygen capacity, the air-fuel ratio detected by the downstream air-fuel ratio sensor will become lean.

In this manner, the controller continues rich combustion until the downstream air-fuel ratio sensor detects a rich air-fuel ratio and then continues lean combustion until the downstream sensor detects a lean air-fuel ratio. The controller calculates the stored oxygen capacity by cumulating the amount of oxygen that flows into the catalytic converter from when the upstream air-fuel ratio sensor detects a lean air-fuel ratio as a result of the lean combustion to when the downstream air-fuel ratio sensor detects a lean air-fuel ratio.

The controller supplies the catalytic converter with oxygen by performing lean combustion to calculate the stored oxygen capacity of the catalytic converter. Such lean combustion will adversely affect the exhaust gas properties and is thus not preferred.

Accordingly, instead of lean combustion, motoring control can be executed to supply the catalytic converter with oxygen. The motoring control cuts off the supply of fuel to all of the cylinders and drives the output shaft of the internal combustion engine with a motor generator so that the engine idles.

The motoring control will, however, consume battery electric power when supplying the catalytic converter with oxygen and calculating the stored oxygen capacity of the catalytic converter. The consumption of battery electric power will result in the need for generating electric power with the internal combustion engine. Thus, when motoring control is executed to calculate the stored oxygen capacity of the catalytic converter, the generation of electric power subsequently performed with the internal combustion engine will lower fuel efficiency.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present disclosure is a controller for an internal combustion engine. The internal combustion engine includes cylinders, a catalytic converter configured to purify exhaust gas and configured to store oxygen, and an exhaust sensor located at a downstream side of the catalytic converter and configured to detect oxygen. The controller includes processing circuitry. The processing circuitry is configured to execute a richening process that supplies the catalytic converter with exhaust gas having an air-fuel ratio that is rich until the exhaust sensor detects that the exhaust gas has a rich air-fuel ratio. After the exhaust sensor detects that the exhaust gas has a rich air-fuel ratio in the richening process, the processing circuitry is configured to execute an air supplying process that supplies the catalytic converter with air until the exhaust sensor detects that the exhaust gas has a lean air-fuel ratio. The processing circuitry is configured to execute a stored oxygen capacity estimating process that estimates a stored oxygen capacity of the catalytic converter by cumulating an amount of air supplied to the catalytic converter until the exhaust sensor detects that the exhaust gas has a lean air-fuel ratio in the air supplying process. The air supplying process includes stopping fuel supplied to one or more of the cylinders and performing combustion at an air-fuel ratio that is less than or equal to a stoichiometric air-fuel ratio in remaining one or more of the cylinders so that the cylinders supply the catalytic converter with exhaust gas, which as a whole, is controlled to have a lean air-fuel ratio.

A further aspect of the present disclosure is a method for controlling an internal combustion engine. The internal combustion engine includes cylinders, a catalytic converter configured to purify exhaust gas and configured to store oxygen, and an exhaust sensor located at a downstream side of the catalytic converter and configured to detect oxygen. The method includes executing a richening process that supplies the catalytic converter with exhaust gas having an air-fuel ratio that is rich until the exhaust sensor detects that the exhaust gas has a rich air-fuel ratio. The method also includes, after the exhaust sensor detects that the exhaust gas has a rich air-fuel ratio in the richening process, executing an air supplying process that supplies the catalytic converter with air until the exhaust sensor detects that the exhaust gas has a lean air-fuel ratio. Further, the method includes executing a stored oxygen capacity estimating process that estimates a stored oxygen capacity of the catalytic converter by cumulating an amount of air supplied to the catalytic converter until the exhaust sensor detects that the exhaust gas has a lean air-fuel ratio in the air supplying process. The air supplying process includes stopping fuel supplied to one or more of the cylinders and performing combustion at an air-fuel ratio that is less than or equal to a stoichiometric air-fuel ratio in remaining one or more of the cylinders so that the cylinders supply the catalytic converter with exhaust gas, which as a whole, is controlled to have a lean air-fuel ratio.

Other features and aspects will be apparent from the following detailed description, the drawings, and the claims.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art In this specification, "at least one of A and B" should be understood to mean "only A, only B, or both A and B."

A controller 39 serving as a controller for an internal combustion engine according to one embodiment and corresponding to a hybrid electric vehicle controller will now be described with reference to FIGS. 1 to 4.

Vehicle Configuration

Figure 1:
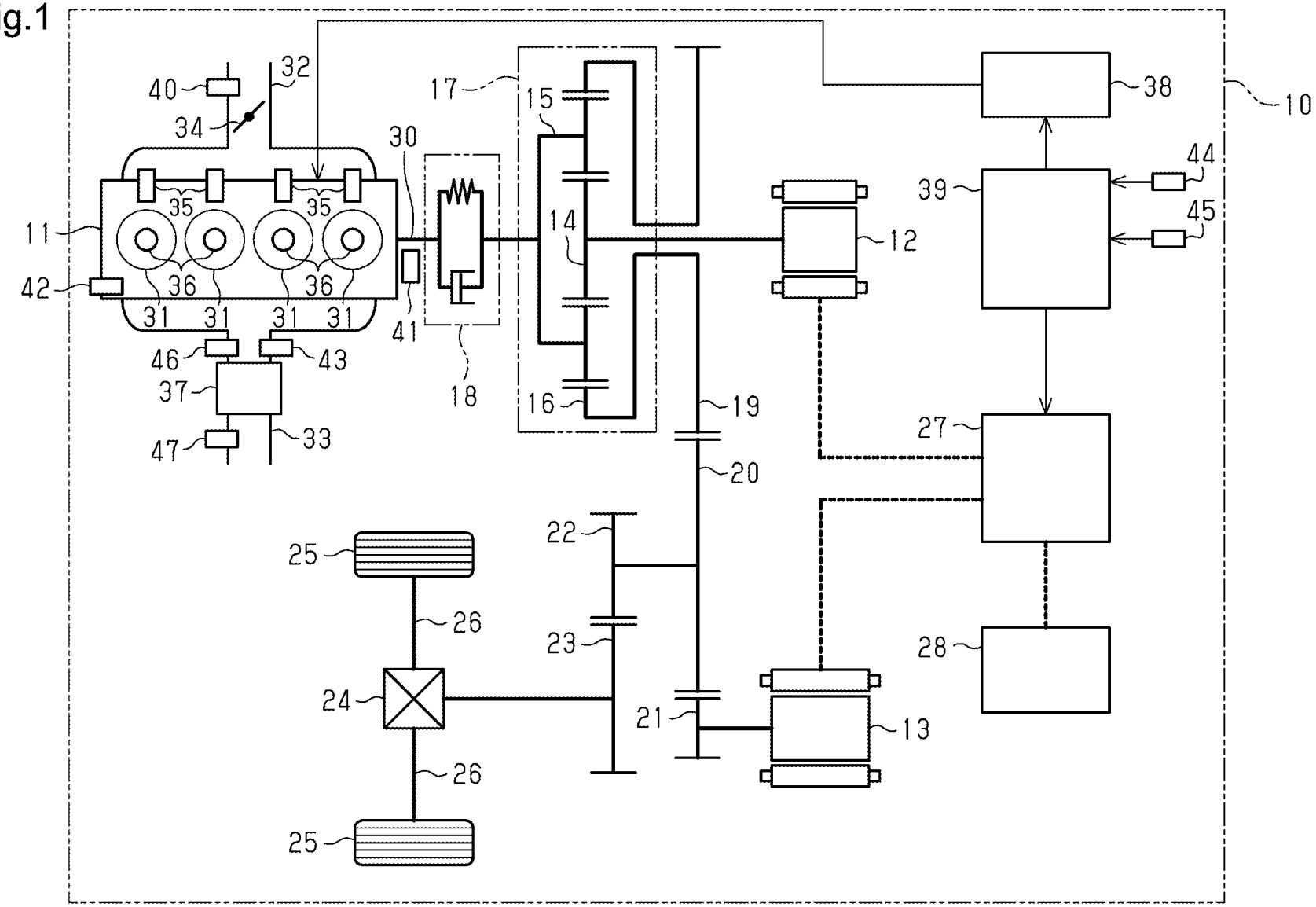
FIG. 1 is a schematic diagram illustrating a controller and a hybrid electric vehicle including an internal combustion engine that is subject to control of the controller.

As shown in FIG. 1, a hybrid electric vehicle 10 of the present embodiment includes an internal combustion engine (hereafter, simply referred to as the engine) 11. The hybrid electric vehicle 10 will hereafter be simply referred to as the vehicle 10. The vehicle 10 includes a battery 28. The vehicle 10 includes a first motor 12 and a second motor 13. The first motor 12 and the second motor 13 are each operated in a motor mode and a generator mode. That is, the first motor 12 and the second motor 13 each function as a motor and a generator. In the motor mode, electric power is supplied from the battery 28 to the first motor 12 and/or the second motor 13, and the supplied power is converted to driving force. That is, the first motor 12 and/or the second motor 13 can drive the vehicle 10. In the generator mode, the first motor 12 and/or the second motor 13 use driving force supplied from an external device to generate electric power. The battery 28 is charged with the electric power generated by the first motor 12 and/or the second motor 13.

The vehicle 10 includes a planetary gear mechanism 17. The planetary gear mechanism 17 includes three rotational elements. More specifically, the planetary gear mechanism 17 includes a sun gear 14, a planetary gear 15, and a ring gear 16. A crank axle 30, which is the output shaft of the engine 11 is coupled to the planetary gear 15 by a transaxle damper 18. The sun gear 14 is coupled to the first motor 12. A counter drive gear 19 is integrated with the ring gear 16. A counter driven gear 20 is meshed with the counter drive gear 19. The second motor 13 is coupled to a reduction gear 21 that is meshed with the counter driven gear 20.

A final drive gear 22 is coupled to the counter driven gear 20 in a manner integrally rotatable with the counter driven gear 20. The final drive gear 22 is meshed with a final driven gear 23. The final driven gear 23 is coupled by a differential mechanism 24 to drive axles 26 of wheels 25.

The first motor 12 and the second motor 13 are electrically connected by a power control unit 27 (hereafter, referred to as the PCU 27) to the battery 28. The PCU 27 regulates the amount of electric power supplied from the battery 28 to the first motor 12 and the second motor 13. The PCU 27 also regulates the amount of electric power supplied from the first motor 12 and the second motor 13 to the battery 28. That is, the PCU 27 regulates the discharge amount and charge amount.

The engine 11 includes cylinders 31, an intake passage 32, and an exhaust passage 33. In the example illustrated in FIG. 1, the engine 11 is a four-cylinder engine including four cylinders 31. Intake air flowing through the intake passage 32 enters the cylinders 31. Air-fuel mixture is burned in each cylinder 31. The exhaust gas resulting from combustion in each cylinder 31 flows into the exhaust passage 33. The intake passage 32 includes a throttle valve 34 to regulate the flowrate of the intake air flowing through the intake passage 32. The cylinders 31 each include a fuel injection valve 35 that injects fuel into the intake air. Each cylinder 31 may be provided with more than one fuel injection valve 35, and each cylinder 31 may be provided with a different number of fuel injection valves 35. Each cylinder 31 is provided with a spark plug 36 that ignites the mixture of air and fuel with an electric spark. Each cylinder 31 may be provided with more than one spark plug 36, and each cylinder 31 may be provided with a different number of spark plugs 36. A catalytic converter 37 is arranged in the exhaust passage 33 to store oxygen and have the stored oxygen react with unburnt fuel so that the exhaust gas can be purified. The catalytic converter 37 removes unburnt fuel from the exhaust gas. A three-way catalyst is carried on the surface of a porous material forming the catalytic converter 37. The catalytic converter 37 may further capture particular matter (PM) suspended in the exhaust gas. Thus, the catalytic converter 37 may be a gasoline particulate filter (GPF) carrying a three-way catalyst.

Controller

The vehicle 10 includes an engine control unit 38. The engine control unit 38 is an electronic control unit that controls the engine 11. Further, the vehicle 10 includes the controller 39 that centrally controls the engine control unit 38 and the PCU 27. The controller 39 is a controller for an internal combustion engine and controls the engine 11 by controlling the engine control unit 38. Further, the controller 39 controls the first motor 12 and the second motor 13 by controlling the PCU 27 to regulate the discharge amount and charge amount. That is, the controller 39 controls the engine 11, the first motor 12, and the second motor 13 to control the vehicle 10. The engine control unit 38 and the controller 39 are each formed by a computer unit. The computer unit includes a read only memory (ROM), a central processing unit (CPU), and a random access memory (RAM). The ROM stores programs and data for control. The CPU executes the programs stored in the ROM. The RAM serves as a working field when the CPU executes a program.

A detection signal of an airflow meter 40 that detects the intake air amount of the engine 11 is input to the engine control unit 38. A detection signal of a crank angle sensor 41 that detects the rotation angle of the crank axle 30 is input to the engine control unit 38. A detection signal of a coolant temperature sensor 42 that detects the coolant temperature of the engine 11 is input to the engine control unit 38. A detection signal of an exhaust gas sensor 43 that detects the temperature of the exhaust gas entering the catalytic converter 37 is input to the engine control unit 38. A detection signal of an upstream air-fuel ratio sensor 46 is input to the engine control unit 38. The upstream air-fuel ratio sensor 46 is located at the upstream side of the catalytic converter 37 in the exhaust passage 33 and detects the oxygen concentration of the gas flowing through the exhaust passage 33. That is, the upstream air-fuel ratio sensor 46 detects the air-fuel ratio. A detection signal of a downstream air-fuel ratio sensor 47 is input to the engine control unit 38. The downstream air-fuel ratio sensor 47 corresponds to an exhaust sensor configured to detect oxygen. The downstream air-fuel ratio sensor 47 is located at the downstream side of the catalytic converter 37 in the exhaust passage 33 and detects the oxygen concentration of the gas flowing through the exhaust passage 33. Thus, the downstream air-fuel ratio sensor 47 is the same type of air-fuel ratio sensor as the upstream air-fuel ratio sensor 46. The upstream air-fuel ratio sensor 46 and the downstream air-fuel ratio sensor 47 may each be a sensor that steeply changes its output once the stoichiometric air-fuel ratio is reached. Thus, the upstream air-fuel ratio sensor 46 and the downstream air-fuel ratio sensor 47 may each be an oxygen sensor that generates a rich output when the air-fuel ratio is richer than the stoichiometric air-fuel ratio and generates a lean output when the air-fuel ratio is leaner than the stoichiometric air-fuel ratio. The engine control unit 38 calculates the rotation speed of the crank axle 30 (hereafter, referred to as the engine speed) from the detection signal of the crank angle sensor 41. Further, the engine control unit 38 calculates an engine load ratio KL from the engine speed and the intake air amount. The engine load ratio KL will now be described. The amount of air drawn into each cylinder 31 in the intake stroke is referred to as a cylinder drawn-in air amount. The cylinder drawn-in air amount when the engine 11 is stably running in a state in which the throttle valve 34 is fully open at the present engine speed is referred to as the fully open air amount. The engine load ratio KL is the ratio of the present cylinder drawn-in air amount to the fully open air amount. The engine control unit 38 executes air-fuel ratio feedback control based on the detection signals of the upstream air-fuel ratio sensor 46 and the downstream air-fuel ratio sensor 47 to regulate the fuel injection amount so that the air-fuel ratio approaches a target air-fuel ratio. For example, in a richening process, which will be described later, an air-fuel ratio that is richer than the stoichiometric air-fuel ratio is set as the target air-fuel ratio. In such a case, the air-fuel ratio is controlled to approach a rich air-fuel ratio through the air-fuel ratio feedback control. This supplies the catalytic converter 37 with exhaust gas having a rich air-fuel ratio.

The current TB, the voltage VB, and the temperature TB of the battery 28 are input to the controller 39. The controller 39 calculates the charge rate, or the state of charge (SOC), of the battery 28 from the current IB, the voltage VB, and the temperature TB. Further, a detection signal of an acceleration pedal sensor 44 that detects the accelerator open degree ACCP, which is the amount of the acceleration pedal depressed by the driver, is input to the controller 39.

A detection signal of a vehicle speed sensor 45 that detects the vehicle speed V, which is the traveling speed of the vehicle 10, is input to the controller 39. The controller 39 calculates a required vehicle driving force, which is the value of the driving force required for the vehicle 10, from the accelerator open degree ACCP and the vehicle speed V. The controller 39 calculates the required engine output, which is the value of the required engine output, from the required vehicle driving force, the charge rate (SOC), and the like. The controller 39 calculates the required MG1 torque, which is the value of the powering/regenerative torque required for the first motor 12, from the required vehicle driving force, the charge rate (SOC), and the like. The controller 39 calculates the required MG2 torque, which is the value of the powering/regenerative torque required for the second motor 13, from the required vehicle driving force, the charge rate (SOC), and the like. Then, traveling control is executed on the vehicle 10. In detail, the engine control unit 38 executes output control on the engine 11 in accordance with the required engine output. The PCU 27 executes torque control on the first motor 12 and the second motor 13 in accordance with the required MG1 torque and the required MG2 torque.

Stored Oxygen Capacity Estimation Process

The controller 39 executes a stored oxygen capacity estimation process to estimate the stored oxygen capacity of the catalytic converter 37. The stored oxygen capacity may be estimated by cumulating the amount of air supplied to the catalytic converter 37 from when the stored oxygen amount becomes zero to when the stored oxygen amount reaches the stored oxygen capacity. Prior to execution of the stored oxygen capacity estimation process, the controller 39 first executes a richening process that supplies the catalytic converter 37 with an exhaust gas having a rich air-fuel ratio until the downstream air-fuel ratio sensor 47 detects that the exhaust gas has a rich air-fuel ratio. When the downstream air-fuel ratio sensor 47 detects a rich air-fuel ratio while the catalytic converter 37 is being supplied with exhaust gas having a rich air-fuel ratio, it is presumed that the stored oxygen amount is zero. In detail, it is presumed that the catalytic converter 37 runs out of oxygen, and the exhaust gas having a rich air-fuel ratio flows downstream from the catalytic converter 37 without being purified by the catalytic converter 37. Then, after the downstream air-fuel ratio sensor 47 detects that the exhaust gas has a rich air-fuel ratio in the richening process, the controller 39 executes an air supplying process that supplies the catalytic converter 37 with air until the downstream air-fuel ratio sensor 47 detects that the exhaust gas has a lean air-fuel ratio. When the downstream air-fuel ratio sensor 47 detects a lean air-fuel ratio while the catalytic converter 37 is being supplied with exhaust gas having a lean air-fuel ratio, it is presumed that the stored oxygen stored oxygen amount has reached the stored oxygen capacity. In detail, it is presumed that when the stored oxygen amount reaches the stored oxygen capacity, the oxygen in the exhaust gas having a lean air-fuel ratio flows downstream from the catalytic converter 37 without being stored in the catalytic converter 37. Thus, the controller 39 estimates the stored oxygen capacity of the catalytic converter 37 in the stored oxygen capacity estimation process by cumulating the amount of air supplied to the catalytic converter 37 until the downstream air-fuel ratio sensor 47 detects that the exhaust gas has a lean air-fuel ratio in the air supplying process. In this manner, the stored oxygen capacity is estimated by cumulating the amount of air supplied to the catalytic converter 37 from when the downstream air-fuel ratio sensor 47 detects that the air-fuel ratio is rich to when the downstream air-fuel ratio sensor 47 detects that the air-fuel ratio is lean. The stored oxygen capacity estimation process will be described in detail later with reference to FIGS. 3 and 4.

Deterioration of Catalytic Converter

Figure 2:
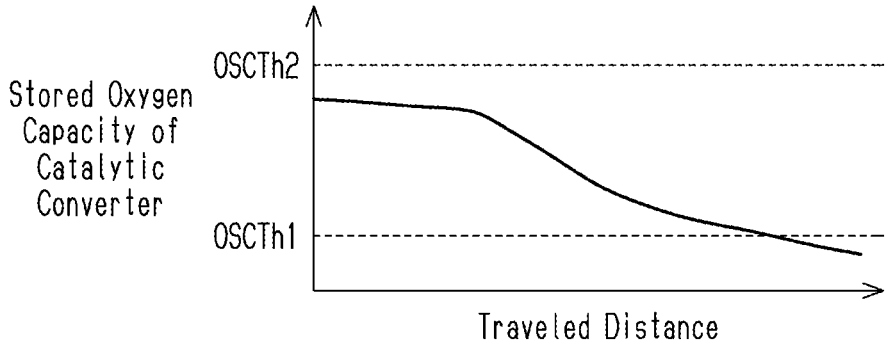
FIG. 2 is a graph illustrating how a catalytic converter deteriorates as the traveled distance increases.

With reference to FIG. 2, deterioration of the catalytic converter 37 that occurs from a state in which the catalytic converter 37 is new will now be described.

When the vehicle 10 travels and operation of the engine 11 is repeated, thermal stress accumulates in the catalytic converter 37 and deteriorates the catalytic converter 37. Thus, as illustrated in FIG. 2, as the traveled distance increases, deterioration of the catalytic converter 37 advances and decreases the stored oxygen capacity of the catalytic converter 37. In the graph of FIG. 2, the vertical axis indicates the stored oxygen capacity of the catalytic converter 37, and the horizontal axis indicates the traveled distance. When the catalytic converter 37 is defective, the catalytic converter 37 cannot store a sufficient amount of oxygen. More specifically, the catalytic converter 37 is presumed as being defective when the stored oxygen capacity of the catalytic converter 37 decreases and becomes lower than a first threshold value OSCTh1. The first threshold value OSCTh1 is a threshold value set in advance taking into consideration the permissible deterioration of the catalytic converter 37. More specifically, when the stored oxygen capacity is greater than or equal to the first threshold value OSCTh1, it is presumed that the catalytic converter is functioning normally. When the stored oxygen capacity is less than the first threshold value OSCTh1, it is presumed that the catalytic converter is defective.

As described above, the stored oxygen capacity of the catalytic converter 37 is estimated based on the cumulative value of the amount of air until the downstream air-fuel ratio sensor 47 indicates a lean air-fuel ratio. Thus, when the estimated stored oxygen capacity is overly greater than the specifications of the catalytic converter 37, it is presumed that the downstream air-fuel ratio sensor 47 is defective. A second threshold value OSCTh2 is set to determine whether the estimated stored oxygen capacity is overly greater than the specifications of the catalytic converter 37. The second threshold value OSCTh2 is a value that is, for example, 1.1 times greater than the stored oxygen capacity of a new catalytic converter 37. The employment of such a configuration allows for determination that the downstream air-fuel ratio sensor 47 is defective when the estimated stored oxygen capacity is greater than the second threshold value OSCTh2. The downstream air-fuel ratio sensor 47 is defective when the downstream air-fuel ratio sensor 47 cannot output a value reflecting the actual air-fuel ratio due to, for example, extremely poor responsivity of the downstream air-fuel ratio sensor 47. When the estimated stored oxygen capacity is less than or equal to the second threshold value OSCTh2, the downstream air-fuel ratio sensor 47 is determined as functioning normally.

Exhaust System Normality Determination Process

Figure 3:
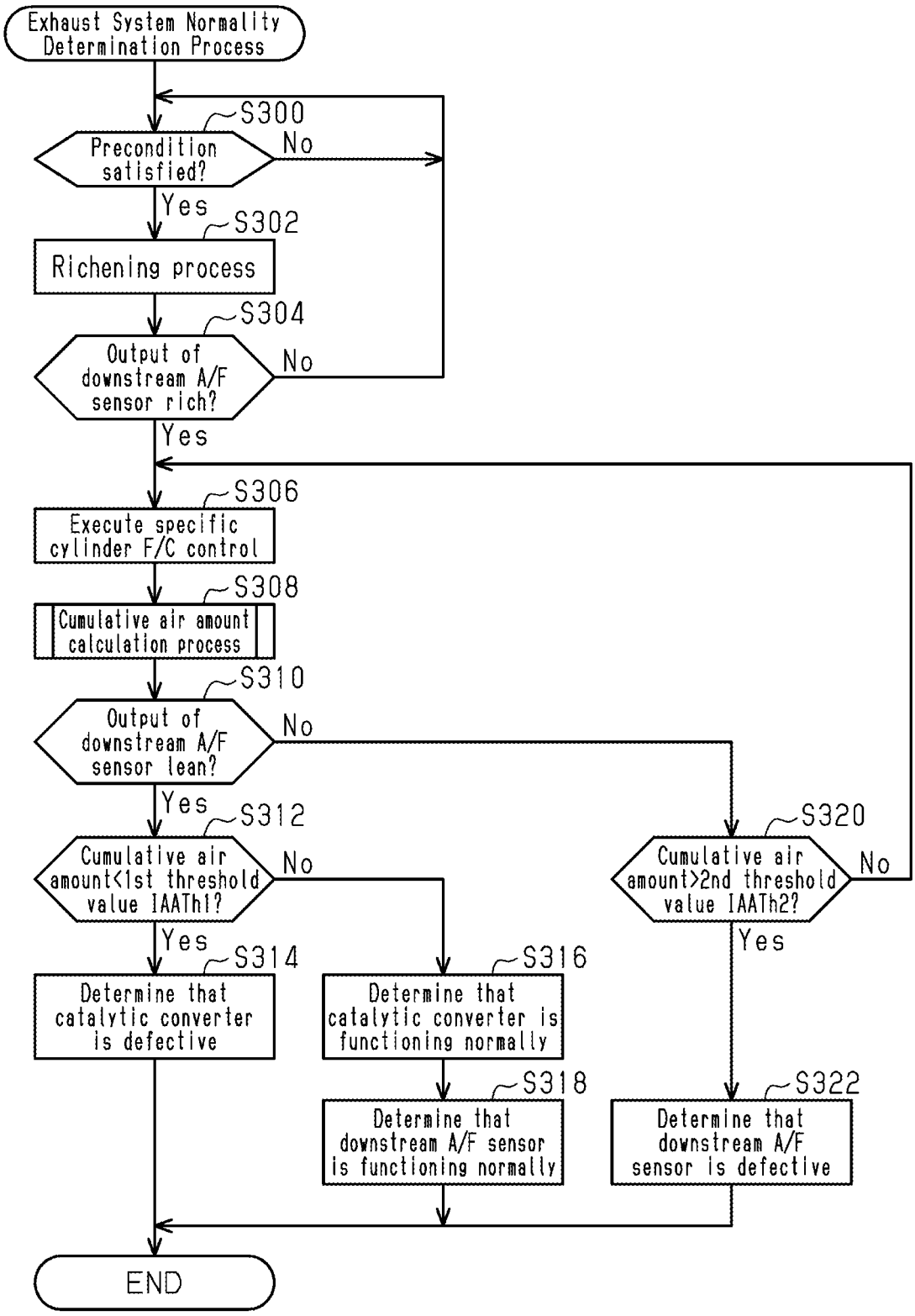
FIG. 3 is a flowchart illustrating an exhaust system normality determination process executed by the controller according to the embodiment.

With reference to FIG. 3, an exhaust system normality determination process for determining whether the catalytic converter 37 or the downstream air-fuel ratio sensor 47 is functioning normally will now be described. The exhaust system normality determination process is executed once under the condition that the main switch of the vehicle 10 is turned on.

In S300, the controller 39 determines whether a precondition for executing subsequent processes is satisfied. The precondition will be described later. When the precondition is not satisfied (S300: No), the controller 39 repeats S300. When the precondition is satisfied (S300: Yes), the controller 39 proceeds to S302. The precondition may include, for example, a condition in which the temperature of the downstream air-fuel ratio sensor 47 is estimated as being greater than or equal to an activated temperature. The detection of the downstream air-fuel ratio sensor 47 is accurate when the temperature of the downstream air-fuel ratio sensor 47 is greater than or equal to the activated temperature. This ensures the accuracy of the exhaust system normality determination process that uses the detection value of the downstream air-fuel ratio sensor 47.

In S302, the controller 39 executes the richening process. In detail, the controller 39 sets the target air-fuel ratio to an air-fuel ratio that is richer than the stoichiometric air-fuel ratio and supplies the catalytic converter 37 with exhaust gas having a rich air-fuel ratio. Then, the controller 39 proceeds to S304.

In S304, the controller 39 determines whether the downstream air-fuel ratio sensor 47 is detecting a rich air-fuel ratio. When the downstream air-fuel ratio sensor 47 is not detecting a rich air-fuel ratio (S304: No), the controller 39 returns to S300. When the downstream air-fuel ratio sensor 47 is detecting a rich air-fuel ratio (S304: Yes), the controller 39 proceeds to S306. When the downstream air-fuel ratio sensor 47 detects a rich air-fuel ratio, it is presumed that the stored oxygen amount of the catalytic converter 37 is zero.

In S306, the controller 39 executes specific cylinder fuel cutoff control (hereafter, referred to as the specific cylinder F/C control). The specific cylinder F/C control stops supplying fuel to one or more of the cylinders 31 and performs combustion at the stoichiometric air-fuel ratio in the remaining one or more of the cylinders 31. For example, in S306, the controller 39 has the engine control unit 38 stop supplying fuel to one of the cylinders 31 and perform combustion at the stoichiometric air-fuel ratio in the remaining three cylinders 31. By executing the specific cylinder F/C control in such a manner, the energy generated by combustion at the stoichiometric air-fuel ratio drives the crank axle 30 and supplies the catalytic converter 37 with air from the cylinder 31 in which the supply of fuel is stopped. Thus, S306 is an air supplying process that supplies the catalytic converter 37 with air. In this manner, the controller 39 executes the air supplying process that supplies the catalytic converter 37 with air. This supplies air to the catalytic converter 37 and allows the output of the engine 11 to be used to drive the wheels 25 or charge the battery 28. Thus, the specific cylinder F/C control is executed when a load is being operated (e.g., when driving force or charging is required). Then, the controller 39 proceeds to S308.

In S308, the controller 39 executes a cumulative air amount calculation process. The cumulative air amount is a value obtained by cumulating the amount of air supplied to the catalytic converter 37 from when the downstream air-fuel ratio sensor 47 detects a rich air-fuel ratio to when the downstream air-fuel ratio sensor 47 detects a lean air-fuel ratio. Here, the cumulative air-fuel ratio is the amount of air cumulated until the downstream air-fuel ratio sensor 47 detects that the air-fuel ratio of the exhaust gas is lean in the air supplying process. The cumulative air amount calculation process is performed in the manner described below.

Figure 4:
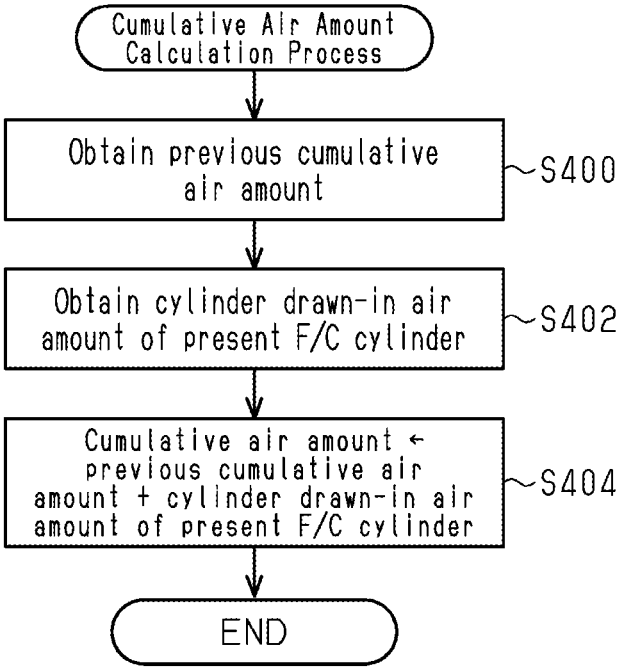
FIG. 4 is a flowchart illustrating a cumulative air amount calculation process executed during the exhaust system normality determination process of FIG. 3.

As shown in FIG. 4, when the cumulative air amount calculation process starts, in S400, the controller 39 obtains the previous cumulative air amount. As described above, the cumulative air amount is a cumulative value taken after the exhaust system normality determination process starts and from when an affirmative determination is given for the first time in S304 and the specific cylinder F/C control is started. Thus, the initial value of the cumulative air amount when the exhaust system normality determination process starts is zero. Then, in S402, the controller 39 obtains the cylinder drawn-in air amount of the present F/C cylinder 31 based on the intake air amount. The F/C cylinder 31 is the cylinder 31 that is undergoing fuel cutoff. The intake air amount is obtained from the detection value of the airflow meter 40. Then, in S404, the controller 39 adds the cylinder drawn-in air amount of the present F/C cylinder 31 to the previous cumulative air amount and updates the cumulative air amount. After the cumulative air amount calculation process, the controller 39 proceeds to S310.

In S310, the controller 39 determines whether the downstream air-fuel ratio sensor 47 is detecting a lean air-fuel ratio. When the downstream air-fuel ratio sensor 47 is detecting a lean air-fuel ratio, it is presumed that the stored oxygen amount has reached the stored oxygen capacity. When a lean air-fuel ratio is detected in S310 by the downstream air-fuel ratio sensor 47 (S310: Yes), the controller 39 proceeds to S312.

In S312, the controller 39 determines whether the cumulative air amount is less than a first threshold value IAATh1. When the cumulative air amount is less than the first threshold value IAATh1 (S312: Yes), the controller 39 proceeds to S314 and determines that the catalytic converter 37 is defective. The first threshold value IAATh1 is a value obtained by converting the first threshold value OSCTh1 to an air amount. The cumulative air amount referred to in S312 is converted to an oxygen amount to obtain the stored oxygen capacity. Comparison of the cumulative air amount with the first threshold value IAATh1 is equivalent to comparison of the stored oxygen capacity with the first threshold value OSCTh1. As described above with reference to FIG. 2, when the stored oxygen capacity is less than the first threshold value OSCTh1, it is presumed that the catalytic converter is defective. When the cumulative air amount is less than the first threshold value IAATh1, the controller 39 determines that the catalytic converter 37 is defective.

When the cumulative air amount is greater than or equal to the first threshold value IAATh1 (S312: No), the controller 39 proceeds to S316 and determines that the catalytic converter 37 is functioning normally. Then, in S318, the controller 39 determines that the downstream air-fuel ratio sensor 47 is functioning normally.

When a lean air-fuel ratio is not detected in S310 by the downstream air-fuel ratio sensor 47 (S310: No), the controller 39 proceeds to S320. In S320, the controller 39 determines whether the cumulative air amount is greater than a second threshold value IAATh2. When the cumulative air amount is greater than the second threshold value IAATh2 (S320: Yes), the controller 39 proceeds to S322 and determines that the downstream air-fuel ratio sensor 47 is defective. The second threshold value IAATh2 is a value obtained by converting the second threshold value OSCTh2 to an air amount. The cumulative air amount referred to in S320 is converted to an oxygen amount to obtain the stored oxygen amount. Comparison of the cumulative air amount with the second threshold value IAATh2 is equivalent to comparison of the stored oxygen amount with the second threshold value OSCTh2. As described above with reference to FIG. 2, when the stored oxygen capacity is greater than the second threshold value OSCTh2, it is presumed that the downstream air-fuel ratio sensor 47 is defective. When the cumulative air amount is greater than the second threshold value IAATh2, the controller 39 determines that the downstream air-fuel ratio sensor 47 is defective. In this case, the cumulative air amount greatly differs from a predetermined range corresponding to the stored oxygen capacity that is in accordance with the specifications of the catalytic converter 37. When the cumulative air amount is less than or equal to the second threshold value IAATh2 (S320: No), the controller 39 proceeds to S306 and continues processing.

The exhaust system normality determination process ends when the controller 39 performs S314, S318, or S322.

Operation of Present Embodiment

The exhaust system normality determination process first sets the stored oxygen amount of the catalytic converter 37 to zero through the richening process (S300 to S304). When the stored oxygen amount of the catalytic converter 37 is zero (S304: Yes), the air supplying process is executed by performing specific cylinder FIC (S306) and the cumulative air amount is calculated (S308). When the downstream air-fuel ratio sensor 47 detects a lean air-fuel ratio (S310: Yes) and oxygen reaches the downstream side of the catalytic converter 37, the calculation of the cumulative air amount is stopped. The cumulative air amount until this point of time is the amount of air supplied to the catalytic converter 37 from when the stored oxygen amount is zero to when the catalytic converter 37 reaches its capacity and cannot store any more oxygen. Thus, the cumulative air amount at this point of time indicates the stored oxygen capacity of the catalytic converter 37. The process in which the cumulative air amount is calculated until the controller 39 gives an affirmative determination in S310 corresponds to the stored oxygen capacity estimation process.

When the stored oxygen capacity estimation process is completed, the exhaust system normality determination process determines from the cumulative air amount that serves as an index value of the stored oxygen capacity whether the catalytic converter 37 or the downstream air-fuel ratio sensor 47 is functioning normally or defective (S314, S316, S318, S322).

Advantages of Present Embodiment (1) The air supplying process includes stopping the fuel supplied to one or more of the cylinders 31 and performing combustion at the stoichiometric air-fuel ratio in the remaining one or more of the cylinders 31. The energy generated by combustion at the stoichiometric air-fuel ratio drives the crank axle 30 and supplies the catalytic converter 37 with air from the one of more cylinders 31 in which the supply of fuel is stopped. Thus, in contrast with when performing lean combustion, the stored oxygen capacity can be estimated without adversely affecting the exhaust gas properties. Further, the air supplying process performed in the present embodiment does not adversely affect fuel efficiency since there is no need to execute motoring control that supplies air to the catalytic converter 37 and lowers the fuel efficiency.

(2) When the catalytic converter 37 is defective, the amount of oxygen that the catalytic converter 37 can store is insufficient. Thus, when the catalytic converter 37 is defective, the cumulative air amount is small when a lean air-fuel ratio is detected. Accordingly, in the configuration described above, the first threshold value IAATh1 is set as a threshold value compared with the cumulative air amount to determine whether the catalytic converter 37 is defective. This configuration allows for determination that the catalytic converter 37 is defective when the cumulative air amount is less than the first threshold value IAATh1.

(3) When the catalytic converter 37 is functioning normally, the catalytic converter 37 can store a sufficient amount of oxygen. Thus, when the catalytic converter 37 is functioning normally, the cumulative air amount is relatively large when a lean air-fuel ratio is detected. Accordingly, in the configuration described above, the first threshold value IAATh1 is set as a threshold value compared with the cumulative air amount to determine whether the catalytic converter 37 is functioning normally. This configuration allows for determination that the catalytic converter 37 is functioning normally when the cumulative air amount is greater than or equal to the first threshold value IAATh1.

(4) The stored oxygen capacity is determined in accordance with the specifications of the catalytic converter 37. This allows for determination that the downstream air-fuel ratio sensor 47 is defective when the cumulative air amount is outside a predetermined range corresponding to the stored oxygen capacity that is in accordance with the specifications of the catalytic converter 37. Accordingly, in the configuration described above, the second threshold value IAATh2 is set as a threshold value compared with the cumulative air amount to determine whether the downstream air-fuel ratio sensor 47 is defective. This configuration allows for determination that the downstream air-fuel ratio sensor 47 is defective when the cumulative air amount is greater than the second threshold value IAATh2.

(5) To supply the catalytic converter 37 with air, fuel cutoff control (hereafter, referred to as the all-cylinder F/C control) can be performed to stop combustion in all of the cylinders 31. However, the all-cylinder F/C control is executed during a non-load state. That is, the all-cylinder F/C control is executed under the condition that driving force and charging are not required. When the vehicle is being driven, driving force and charging are often required. Thus, when the all-cylinder F/C control is executed to perform the air supplying process, the all-cylinder F/C control will be ended before the stored oxygen amount of the catalytic converter 37 reaches the stored oxygen capacity. This will prolong the time taken to complete the estimation of the stored oxygen capacity. In contrast, the specific cylinder F/C control is executed when driving force or charging is required. Thus, the present embodiment provides more opportunities for calculating the cumulative air amount to estimate the stored oxygen capacity than when the catalytic converter 37 is supplied with air through only the all-cylinder F/C control.

(6) Instead of lean combustion, the catalytic converter 37 is supplied with air through the specific cylinder F/C control when estimating the stored oxygen capacity. The specific cylinder F/C control supplies air to the catalytic converter 37 more efficiently than lean combustion. Thus, the specific cylinder F/C control allows the stored oxygen capacity to be estimated more quickly than a configuration that estimates the stored oxygen capacity through lean combustion.

(7) When the specific cylinder F/C control is executed, combustion is performed at the stoichiometric air-fuel ratio in the cylinders 31 other than the F/C cylinder 31. This avoids a situation in which the unburnt fuel supplied from the cylinders 31 other than the F/C cylinder 31 to the catalytic converter 37 reacts with the oxygen in the catalytic converter 37. Thus, the stored oxygen capacity can be estimated further accurately.

Further, there is no need for the cumulative air amount to include the amount of air supplied to the catalytic converter 37 from cylinders other than the F/C cylinder 31. If lean combustion were to be performed in the cylinders 31 other than the F/C cylinder 31, the amount of air supplied from the cylinders 31 other than the F/C cylinder 31 to the catalytic converter 37 would have to be calculated from the output of the upstream air-fuel ratio sensor 46. In the present embodiment, combustion is performed at the stoichiometric air-fuel ratio in the cylinders 31 other than the F/C cylinder 31. Thus, the upstream air-fuel ratio sensor 46 is unnecessary. This eliminates the possibility of the gain or response of the upstream air-fuel ratio sensor 46 adversely affecting the calculation of the cumulative air amount.

Modified Examples

The present embodiment may be modified as described below. The present embodiment and the following modifications can be combined as long as there is no technical contradiction.

In the above embodiment, the air supplying process includes stopping the fuel supplied to one or more of the cylinders 31 and performing combustion at the stoichiometric air-fuel ratio in the remaining one or more of the cylinders 31. Instead, the air supplying process may include stopping the fuel supplied to one or more of the cylinders 31 and performing combustion at an air-fuel ratio that is less than the stoichiometric air-fuel ratio in the remaining one or more of the cylinders 31 so that the cylinders 31 supply the catalytic converter 37 with exhaust gas, which as a whole, is controlled to have a lean air-fuel ratio. In such a case, the cylinders 31 that perform combustion do not perform lean combustion. Thus, in contrast with when performing lean combustion, the stored oxygen capacity can be estimated without adversely affecting the exhaust gas properties. To execute the exhaust system normality determination process further accurately, the cumulative air amount in S312 or S320 may be obtained by subtracting the amount of air reacting with the unburnt fuel supplied to the catalytic converter 37 from the cylinders 31 performing combustion at an air-fuel ratio that is less than the stoichiometric air-fuel ratio.

The upstream air-fuel ratio sensor 46 may be omitted.

The above embodiment is an example in which the air supplying process is performed through only the specific cylinder F/C control. However, the air supplying process may also be combined with all-cylinder F/C control. More specifically, air may be supplied through the specific cylinder F/C control during a load operation, and air may be supplied through the all-cylinder F/C control during a non-load state. Such a configuration allows air to be supplied regardless of whether a non-load operation is being performed or a load operation is being performed. Thus, the catalytic converter 37 can be supplied with air in a continuous and seamless manner. This allows for prompt completion of the stored oxygen amount estimation process.

In the air supplying process of the above embodiment, the engine control unit 38 stops supplying fuel to one of the cylinders 31 and performs combustion at the stoichiometric air-fuel ratio in the remaining three cylinders 31. Instead, for example, in the air supplying process, the engine control unit 38 may stop supplying fuel to two of the cylinders 31 and perform combustion at the stoichiometric air-fuel ratio in the remaining two cylinders 31. That is, the number of cylinders 31 to which the supply of air is stopped in the air supplying process is not limited to one. The cylinders 31 that undergo fuel cutoff may be changed. Further, fuel cutoff may be performed on one or more specific ones of the cylinders 31.

In a specified one of the cylinders 31, fuel cutoff may be performed at a frequency of once every multiple number of combustion cycles.

When the specific cylinder F/C control is executed, a momentary torque loss occurs. Momentary torque loss may lead to insufficient driving force and increase noise and vibration. When the specific cylinder F/C control is executed, a process for avoiding such insufficient driving force and/or increased noise and vibration may be executed. For example, a process that increases the output value required for the engine 11 may be executed to compensate for a decrease in the output of the engine 11 so that the driving force does not become insufficient. A process that compensates for a decrease in the output of the engine 11 with the first motor 12 and/or the second motor 13 may be executed so that the driving force does not become insufficient. A process may be performed to cyclically compensate for torque pulsations of the engine 11 with motor torque and reduce noise and vibration.

The precondition may include, for example, that the execution of a process is permitted for avoiding insufficient driving force and/or increased noise and vibration that would be caused by momentary torque loss. The precondition may include, for example, that the battery 28 is in a predetermined state. This avoids a situation in which the process described above that uses the battery 28 cannot be executed due to low temperature or low charge rate of the battery 28. The precondition may include, for example, that the first motor 12 and/or the second motor 13 are in a specified state. For example, execution of the process described above using the first motor 12 and/or the second motor 13 may be avoided avoid when the first motor 12 and/or the second motor 13 includes a component (e.g., coil or inverter) having a high temperature and the torque of the first motor 12 and/or the second motor 13 is restricted to protect the component. The precondition may include, for example, that the state of communication is in a predetermined state (e.g., no communication disruption and no communication delay). This ensures the reliability of communication performed between ECUs to execute the process described above.

When the specific cylinder F/C control is interrupted during the exhaust system normality determination process, the exhaust system normality determination process is interrupted. A process may be performed to avoid interruption of the specific cylinder F/C control. For example, after prohibiting intermittent stopping or prohibiting all-cylinder F/C control in a hybrid electric vehicle, a control may be executed to maintain or increase required output for the engine, and the battery 28 may be charged or discharged to correct lacking or excessive output of the engine 11.

When the specific cylinder F/C control is executed, air-fuel ratio feedback control can be suspended. Alternatively, the feedback gain may be decreased when the specific cylinder F/C control is executed. This avoids a situation in which the specific cylinder F/C control causes a lean spark (air-fuel ratio becomes transitionally lean) and the target air-fuel ratio in a combustion cylinder 31 that performs combustion is corrected to be rich.

The specific cylinder F/C control may cause a lean spark that results in inappropriate updating of an air-fuel ratio learned value. This may be prevented by stopping air-fuel ratio learning control during the specific cylinder F/C control.

Ignition of the F/C cylinder 31 may be suspended during the specific cylinder F/C control. This avoids unintentional combustion in the F/C cylinder 31. Additionally, methods that can be taken to avoid unintentional combustion in the F/C cylinder 31 include purge cutoff, direct fuel injection in the combustion cylinder 31, fuel injection synchronized with opening of intake valve in a configuration including only a port injection valve, EGR cutoff, and advancing of intake valve timing to limit reversed flow of air-fuel mixture to intake system, and the like.

In the above embodiment, the number of the cylinders 31 is four. The number of the cylinders 31 may be changed.

In the above embodiment, a process for determining whether the catalytic converter 37 is defective or functioning normally and a process for determining whether the downstream air-fuel ratio sensor 47 is defective or functioning normally are performed. These processes may be omitted. More specifically, S312, S314, S316 S318 S320, and S322 may be omitted.

In the above embodiment, the exhaust system normality determination process is executed once under the condition that the main switch of the vehicle 10 is turned on. Instead, for example, the exhaust system normality determination process may be executed more than once when the deviation of the cumulative air amount and the first threshold value IAATh1 is small or when the deviation of the cumulative air amount and the second threshold value IAATh2 is small. The determination of whether the exhaust system is functioning normally is further accurate when based on the results of the exhaust system normality determination process performed a number of times.

In the exhaust system normality determination process, when the catalytic converter 37 or the downstream air-fuel ratio sensor 47 is determined as being defective, the anomaly can be determined through another method such as that described in the BACKGROUND section.

In the above embodiment, the exhaust system normality determination process is executed once under the condition that the main switch of the vehicle 10 is turned on. Instead, for example, the exhaust system normality determination process may be executed under the condition that the specific cylinder F/C control is executed to reduce emissions during stable driving or the specific cylinder F/C control is executed for the purpose of GPF regeneration.

The precondition of the exhaust system normality determination process described in the above embodiment may be changed. For example, the precondition may include a condition in that the components or sensors used for calculation of the cumulative air amount (e.g., throttle valve 34 and airflow meter 40) are functioning normally. This ensures the accuracy of the exhaust system normality determination process. For example, the precondition may include a condition in that the engine coolant temperature and oil temperature are greater than or equal to 75 degrees Celsius indicating that warming of the engine 11 has been completed. The precondition may include a condition in that the engine 11 is running and not in a stopped state. For example, the precondition can include a condition in that a control that may change the air-fuel ratio from the stoichiometric air-fuel ratio is not being executed. This is, for example, a condition in that a special fuel increasing control is not being executed. The special fuel increasing control may be performed for the purpose of, for example, protecting components. The component protection fuel increasing control impedes deterioration of components that come into contact with the exhaust gas of which the temperature is lowered when fuel is increased. The special fuel increasing control is performed, for example, when increasing power, when the engine is cold, immediately after the engine is started, or after fuel cutoff ends. When a special fuel increasing control is not executed, combustion is performed at the stoichiometric air-fuel ratio in cylinders 31 other than the F/C cylinder 31. This allows the cumulative air amount to be accurately calculated based on the amount of air supplied from the F/C cylinder 31 to the catalytic converter 37. The precondition may include, for example, a condition that the temperature of the catalytic converter 37 is within a predetermined range (e.g., 500 degrees Celsius to 800 degrees Celsius). The temperature of the catalytic converter 37 may affect the stored oxygen capacity. The lower limit value of the predetermined range may be the catalyst activation temperature, and the upper limit value of the predetermined range may be a component protection temperature. The predetermined condition may include, for example, a condition that the engine speed is low and the load variation is small. That is, the precondition may include a condition in that the engine 11 is not in a transitional operation state. This avoids a situation in which a transitional operation state of the engine 11 lowers the calculation accuracy of the cumulative air amount and destabilizes control of the air-fuel ratio. For example, the condition can be set for an engine including a port injection valve to avoid a situation in which a port wet amount during a transitional operation state of the engine destabilizes the air-fuel ratio. The precondition may include, for example, a condition related to the ambient pressure, the intake air temperature, and the ambient temperature that affect the calculation of the cumulative air amount. The precondition may include, for example, a condition that the intake air amount is in a predetermined range (e.g., 5 to 30 g/s). The lower limit value of the intake air amount is set to avoid a situation in which the exhaust system normality determination process that is based on the cumulative air amount will take time when the intake air amount is too small. The upper limit value of the intake air amount is set to ensure the reliability of the exhaust system normality determination process that is based on the cumulative air amount. If the intake air amount were to be too large, when S306 and S308 are performed for the first time, the output of the downstream air-fuel ratio sensor 47 would be lean, and the output of the cumulative air amount may exceed the first threshold value IAATh1. In such a case, the catalytic converter 37 will not be determined as being defective even when the stored oxygen capacity becomes less than the first threshold value OSCTh1. The precondition may include, for example, a condition in that a control that may supply fuel to the F/C cylinder 31 is not being executed. This avoids a situation in which the air supplied from the F/C cylinder 31 to the catalytic converter 37 reacts with fuel and hinders calculation of the cumulative air amount. For the same reason, the precondition may include, for example, a condition in that the purge concentration (concentration of fuel vapor flowing from fuel tank into intake passage 32) is small (e.g., zero) and/or and the exhaust gas recirculation (EGR) amount is small (e.g., zero). The precondition may include, for example, a condition in that learning of the air-fuel ratio control is completed in the operating range of the engine 11 and near the operating range at the point of time in which the exhaust system normality determination process is executed. This ensures the accuracy for controlling the air-fuel ratio at the stoichiometric air-fuel ratio.

In the above embodiment, the controller 39 compares the cumulative air amount with the first threshold value IAATh1 or the second threshold value IAATh2. However, this is only an example. The controller 39 can convert the cumulative air amount to an oxygen amount and compare the converted oxygen amount with the first threshold value OSCTh1 or the second threshold value OSCTh2.

In the above embodiment, the intake air amount of the F/C cylinder 31 is obtained from the detection value of the airflow meter 40. Instead, the intake air amount may be calculated from an intake system physical model. For example, the intake air amount may be calculated from the specifications, a throttle open degree, and an actuation amount of variable valve timing (VVT), EGR, or the like. Instead, the intake air amount may be obtained by an intake manifold pressure sensor.

In the above embodiment, the controller 39 determines in S318 that the downstream air-fuel ratio sensor 47 is functioning normally when the cumulative air amount is greater than or equal to the first threshold value IAATh1. The controller 39 may determine that the downstream air-fuel ratio sensor 47 is functioning normally if the cumulative air amount taken when a lean air-fuel ratio is detected is less than or equal to the second threshold value IAATh2. The stored oxygen capacity is determined in accordance with the specifications of the catalytic converter 37. Thus, when the cumulative air amount is included in a predetermined range corresponding to the stored oxygen capacity that is in accordance with the specifications of the catalytic converter 37, the downstream air-fuel ratio sensor 47 can be determined as functioning normally. Accordingly, in the configuration described, the second threshold value IAATh2 is set as a threshold value compared with the cumulative air amount to determine whether the downstream air-fuel ratio sensor 47 is functioning normally. This configuration allows for determination that the downstream air-fuel ratio sensor 47 is functioning normally when the cumulative air amount is less than or equal to the second threshold value IAATh2.

When the exhaust system normality determination process ends, the control state may be returned to the original control state from the specific cylinder F/C control and the like. However, when the specific cylinder F/C control is required to raise the temperature for GPF regeneration, the specific cylinder F/C control may be continued.

When the exhaust system normality determination process ends, the amount of oxygen supplied to the catalytic converter 37 may be in excess. Thus, after the exhaust system normality determination process ends, the fuel injection amount may be increased by, for example, setting a target air-fuel ratio that is richer than normal.

During the exhaust system normality determination process, the temperature of the cylinder 31 undergoing fuel cutoff is lower than that of the other cylinders 31 undergoing combustion and thus in an insufficient port wet state. Thus, after the exhaust system normality determination process, a greater amount of fuel may be injected into the cylinder 31 that underwent fuel cutoff than the other cylinders 31 that underwent combustion so that the torque generated by the cylinders 31 is uniform.

In the above embodiment, the controller 39 includes a CPU, a ROM, and a RAM and processes software. However, this is only an example. For example, the controller 39 may include a dedicated hardware circuit, such as application-specific integrated circuit (ASIC), that processes at least part of the processes executed by software in the present embodiment. That is, the controller 39 may have any of following configurations (a) to (c). (a) The controller 39 includes a processor that executes all of the processes according to programs and a program storage device such as a ROM that stores the programs. That is, the controller 39 includes a software execution device. (b) The controller 39 includes a processor that executes part of the processes according to programs and a program storage device. Further, the controller 39 includes a dedicated hardware circuit that executes the remaining processes. (c) The controller 39 includes a dedicated hardware circuit that executes all of the processes. There may be more than one software processing device and/or dedicated hardware circuit. That is, the above processes may be executed by processing circuitry including at least one of a set of one or more software processing devices and a set of one or more dedicated hardware circuits. The processing circuitry may include more than one software processing device and/or exclusive hardware circuit. The program storage device, or computer readable medium, includes any available medium that is accessible by a versatile or dedicated computer.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A controller for an internal combustion engine, wherein the internal combustion engine includes cylinders, a catalytic converter configured to purify exhaust gas and configured to store oxygen, and an exhaust sensor located at a downstream side of the catalytic converter and configured to detect oxygen, the controller comprising:

processing circuitry, wherein:

the processing circuitry is configured to execute a richening process that supplies the catalytic converter with exhaust gas having an air-fuel ratio that is rich until the exhaust sensor detects that the exhaust gas has a rich air-fuel ratio;

after the exhaust sensor detects that the exhaust gas has a rich air-fuel ratio in the richening process, the processing circuitry is configured to execute an air supplying process that supplies the catalytic converter with air until the exhaust sensor detects that the exhaust gas has a lean air-fuel ratio;

the processing circuitry is configured to execute a stored oxygen capacity estimating process that estimates a stored oxygen capacity of the catalytic converter by cumulating an amount of air supplied to the catalytic converter until the exhaust sensor detects that the exhaust gas has a lean air-fuel ratio in the air supplying process; and the air supplying process includes stopping fuel supplied to one or more of the cylinders and performing combustion at an air-fuel ratio that is less than or equal to a stoichiometric air-fuel ratio in remaining one or more of the cylinders so that the cylinders supply the catalytic converter with exhaust gas, which as a whole, is controlled to have a lean air-fuel ratio.

2. The controller according to claim 1, wherein the processing circuitry is configured to determine that the catalytic converter is defective when a cumulative air amount is less than a first threshold value, the cumulative air amount being the amount of air cumulated until the exhaust sensor detects that the exhaust gas has a lean air-fuel ratio in the air supplying process.

3. The controller according to claim 1, wherein the processing circuitry is configured to determine that the catalytic converter is functioning normally when a cumulative air amount is greater than or equal to a first threshold value, the cumulative air amount being the amount of air cumulated until the exhaust sensor detects that the exhaust gas has a lean air-fuel ratio in the air supplying process.

4. The controller according to claim 2, wherein the processing circuitry is configured to determine that the exhaust sensor is functioning normally when the cumulative air amount is less than or equal to a second threshold value that is greater than the first threshold value.

5. The controller according to claim 2, wherein the processing circuitry is configured to determine that the exhaust sensor is defective when the cumulative air amount is greater than a second threshold value that is greater than the first threshold value.

6. The controller according to claim 1, wherein the air supplying process includes stopping fuel supplied to the one or more of the cylinders and performing combustion at the stoichiometric air-fuel ratio in the remaining one or more of the cylinders.

7. A method for controlling an internal combustion engine, wherein the internal combustion engine includes cylinders, a catalytic converter configured to purify exhaust gas and configured to store oxygen, and an exhaust sensor located at a downstream side of the catalytic converter and configured to detect oxygen, the method comprising:

executing a richening process that supplies the catalytic converter with exhaust gas having an air-fuel ratio that is rich until the exhaust sensor detects that the exhaust gas has a rich air-fuel ratio;

after the exhaust sensor detects that the exhaust gas has a rich air-fuel ratio in the richening process, executing an air supplying process that supplies the catalytic converter with air until the exhaust sensor detects that the exhaust gas has a lean air-fuel ratio; and executing a stored oxygen capacity estimating process that estimates a stored oxygen capacity of the catalytic converter by cumulating an amount of air supplied to the catalytic converter until the exhaust sensor detects that the exhaust gas has a lean air-fuel ratio in the air supplying process;

wherein the air supplying process includes stopping fuel supplied to one or more of the cylinders and performing combustion at an air-fuel ratio that is less than or equal to a stoichiometric air-fuel ratio in remaining one or more of the cylinders so that the cylinders supply the catalytic converter with exhaust gas, which as a whole, is controlled to have a lean air-fuel ratio.

* * * * *